US010116062B2

(12) United States Patent
Zhang et al.

(10) Patent No.: US 10,116,062 B2
(45) Date of Patent: Oct. 30, 2018

(54) LOOPED MULTI-BRANCH PLANAR ANTENNAS HAVING A FLOATING PARASITIC ELEMENT AND WIRELESS COMMUNICATIONS DEVICES INCORPORATING THE SAME

(75) Inventors: Zheng Zhang, Lund (SE); Bangguo Zhu, Lund (SE); Zhinong Ying, Lund (SE)

(73) Assignee: Sony Mobile Communications Inc., Tokyo (JP)

( * ) Notice: Subject to any disclaimer, the term of this patent is extended or adjusted under 35 U.S.C. 154(b) by 313 days.

(21) Appl. No.: 13/816,941

(22) PCT Filed: May 7, 2012

(86) PCT No.: PCT/IB2012/000891
§ 371 (c)(1),
(2), (4) Date: Mar. 5, 2013

(87) PCT Pub. No.: WO2013/167925
PCT Pub. Date: Nov. 14, 2013

(65) Prior Publication Data

US 2013/0293427 A1 Nov. 7, 2013

(51) Int. Cl.
*H01Q 21/29* (2006.01)
*H01Q 19/28* (2006.01)
(Continued)

(52) U.S. Cl.
CPC ..... *H01Q 19/28* (2013.01); *H01Q 1/243* (2013.01); *H01Q 1/245* (2013.01); *H01Q 1/38* (2013.01);
(Continued)

(58) Field of Classification Search
CPC ..... H01Q 1/243; H01Q 5/385; H01Q 19/28; H01Q 7/00; H01Q 1/245; H01Q 21/29; H01Q 1/38
See application file for complete search history.

(56) References Cited

U.S. PATENT DOCUMENTS 6,650,294 B2 * 11/2003 Ying et al. ..... 343/700 MS
2003/0151556 A1 * 8/2003 Cohen ..... 343/700 MS
(Continued)

FOREIGN PATENT DOCUMENTS

WO WO 02/071536 A1 9/2002
WO WO 2011/076582 A1 6/2011
WO WO 2011076582 A1 * 6/2011 ..... H01Q 1/243

OTHER PUBLICATIONS

Notification of Transmittal of the International Search Report and the Written Opinion of the International Searching Authority, or the Declaration, PCT/IB2012/000891, dated Jan. 23, 2013.
(Continued)

*Primary Examiner* — Graham Smith
*Assistant Examiner* — Noel Maldonado
(74) *Attorney, Agent, or Firm* — Myers Bigel, P.A.

(57) ABSTRACT

Antenna systems are provided including a ground plane; a loop antenna positioned on the ground plane on a first layer, the loop antenna having antenna feed positioned at a center of an edge of the first layer; and a multi-branch parasitic element electrically coupled to the loop antenna, the multi-branch parasitic element being parallel to and positioned above the ground plane on a second layer, different from the first layer, wherein the loop antenna on the first layer is positioned between the ground plane and the multi-branch parasitic element on the second layer. Related wireless communications devices and loop antennas are also provided herein.

19 Claims, 17 Drawing Sheets

(51) Int. Cl.

| | |
|---|---|
| ***H01Q 1/24*** | (2006.01) |
| ***H01Q 1/38*** | (2006.01) |
| ***H01Q 7/00*** | (2006.01) |
| ***H01Q 5/385*** | (2015.01) |

(52) U.S. Cl.
CPC ..... *H01Q 5/385* (2015.01); *H01Q 7/00* (2013.01); *H01Q 21/29* (2013.01)

(56) References Cited

U.S. PATENT DOCUMENTS

| | | | | |
|---|---|---|---|---|
| 2005/0093750 | A1* | 5/2005 | Vance | H01Q 1/243 343/702 |
| 2010/0234081 | A1* | 9/2010 | Wong et al. | 455/575.5 |
| 2013/0057442 | A1* | 3/2013 | Brown | H01Q 1/48 343/750 |
| 2013/0201074 | A1* | 8/2013 | Harper | H01Q 1/38 343/870 |

OTHER PUBLICATIONS

Notification Concerning Transmittal of International Preliminary Report on Patentability, PCT/IB2012/000891, dated Nov. 11, 2014, 8 pages.

* cited by examiner

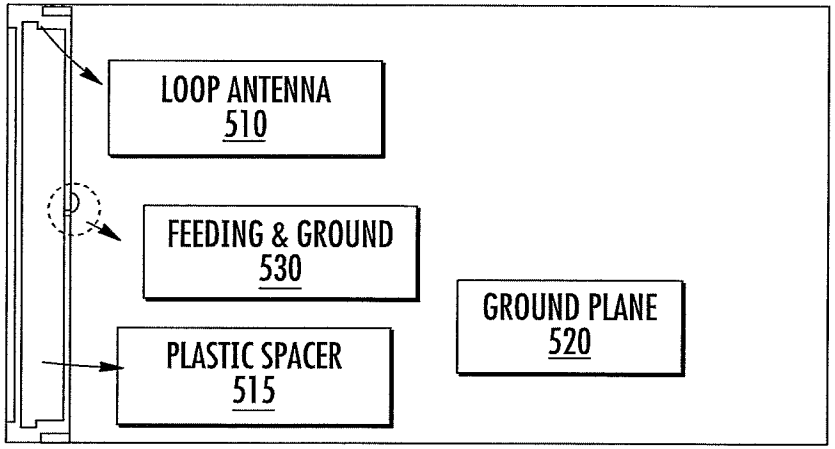
FIG. 5A
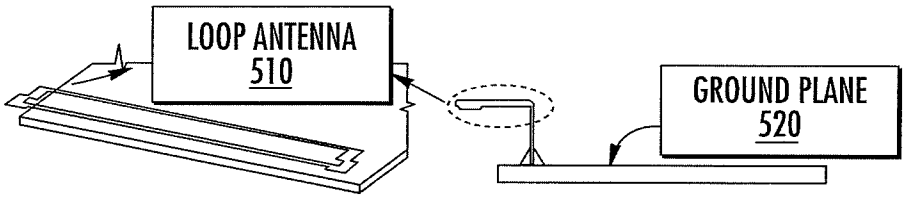
FIG. 5B
FIG. 5C

LOOPED MULTI-BRANCH PLANAR ANTENNAS HAVING A FLOATING PARASITIC ELEMENT AND WIRELESS COMMUNICATIONS DEVICES INCORPORATING THE SAME

CROSS-REFERENCE TO RELATED APPLICATION

This application is a 35 U.S.C. § 371 national stage application of PCT International Application No. PCT/IB2012/000891, filed on May 7, 2012, the disclosure and contents of which are incorporated by reference herein as if set forth in its entirety.

FIELD

The present application relates generally to communication devices, and more particularly to, antennas and wireless communications devices using antennas.

BACKGROUND

Various digital mobile phone standards are currently deployed worldwide. These standards include, for example, Global System for Mobile Communications (GSM) and Universal Mobile Telecommunications Service (UMTS) in Europe and (Code-Division Multiple Access) CDMA in the United States. Due to the increasing demand for mobile telephone services, many of these standards are deployed together. In addition, further deployments of new standards are currently underway or will be in the foreseeable future. For example, the Long Term Evolution (LTE) standard and the IEEE 802.16 (WiMax) standard are currently being deployed.

In the transition from the currently deployed standards (second generation) to the third or fourth generation standards, both second and third generation standards currently coexist and will continue to do so for the foreseeable future. Thus, multi-frequency band systems, that include two or more frequency bands belonging to two or more communication standards will continue to coexist in parallel and will work together to provide coverage and services to the wireless communications devices.

Many new frequency bands have been deployed for use and operators are requesting increased roaming capability. Roaming is a general term referring to the extension of connectivity service in a location that is different from a home location where the service was registered. Roaming typical increases the likelihood that the wireless communications device is connected to the network, without losing the connection. Thus, there is now a demand for wireless communications devices to support more than one frequency band. For example, legacy GSM/Enhanced Data GSM Environment (EDGE) may be required on overlapping Wideband Code-Division Multiple Access (WCDMA) frequency bands, such as GSM850/WCDMA B5 and GSM900/WCDMA B8.

Furthermore, before being deployed these wireless communications devices are required to undergo rigorous testing to ensure that a desired quality of service is provided to users of the wireless communications devices. Some of these tests are over the air (OTA) performance tests, which are commonly performed with head and/or hand phantoms, i.e. models of the human hand and/or head configured to hold the wireless communications device during performance testing. Since the position of the wireless communications device in the hand of the user and/or against the head of the user changes the performance of the wireless communications device, for example, antenna performance, use of these head and hand phantoms may allow performance testing to better simulate real world conditions.

SUMMARY

Some embodiments of the present inventive concept provide an antenna system including a ground plane; a loop antenna positioned on the ground plane on a first layer, the loop antenna having antenna feed positioned at a center of an edge of the first layer; and a multi-branch parasitic element electrically coupled to the loop antenna, the multi-branch parasitic element being parallel to and positioned above the ground plane on a second layer, different from the first layer, wherein the loop antenna on the first layer is positioned between the ground plane and the multi-branch parasitic element on the second layer.

In further embodiments, a plastic spacer may be positioned between the loop antenna and the multi-branch parasitic element.

In still further embodiments, the loop antenna may be one of grounded, semi-on grounded and ground free.

In some embodiments, the antenna system may provide a decrease in body loss between left and right sides of a user in a high frequency band. The high frequency band may be from about 1700 MHz to beyond 2700 MHz.

In further embodiments, the antenna system may further include a back cover of a wireless communications device and the multi-branch parasitic element may be integrated with an outer surface of the back cover of the wireless communications device.

In still further embodiments, the antenna system may further include a back cover of a wireless communications device. The multi-branch parasitic element may be integrated on a first surface of the back cover of the wireless communications device and the loop antenna may be integrated with a second surface of the wireless communications device, the second surface being opposite the first surface.

Some embodiments of the present inventive concept provide a wireless communications device including a housing and an antenna system coupled to the housing. The antenna system includes a ground plane; a loop antenna positioned on the ground plane on a first layer, the loop antenna having antenna feed positioned at a center of an edge of the first layer; and a multi-branch parasitic element electrically coupled to the loop antenna, the multi-branch parasitic element being parallel to and positioned above the ground plane on a second layer, different from the first layer, wherein the loop antenna on the first layer is positioned between the ground plane and the multi-branch parasitic element on the second layer.

Further embodiments of the present inventive concept provide a loop antenna comprising a floating multi-branch parasitic element configured to reduce imbalance of left and right side over the air performance in high frequency bands.

In still further embodiments, the variation in performance between the left and right side over the air performance may be reduced to no greater than about 1.0 dB in the high frequency band.

Other antennas, communications devices, and/or methods according to embodiments of the inventive concept will be or become apparent to one with skill in the art upon review of the following drawings and detailed description. It is intended that all such additional antennas, communications devices, and/or methods be included within this description, be within the scope of the present inventive concept, and be protected by the accompanying claims. Moreover, it is intended that all embodiments disclosed herein can be implemented separately or combined in any way and/or combination.

BRIEF DESCRIPTION OF THE DRAWINGS

The accompanying drawings, which are included to provide a further understanding of the inventive concept and are incorporated in and constitute a part of this application, illustrate certain embodiment(s) of the inventive concept. In the drawings:

FIGS. 5A through 5D are diagrams illustrating another conventional loop antenna (semi on ground) design.

DETAILED DESCRIPTION OF EMBODIMENTS

Figure 1:
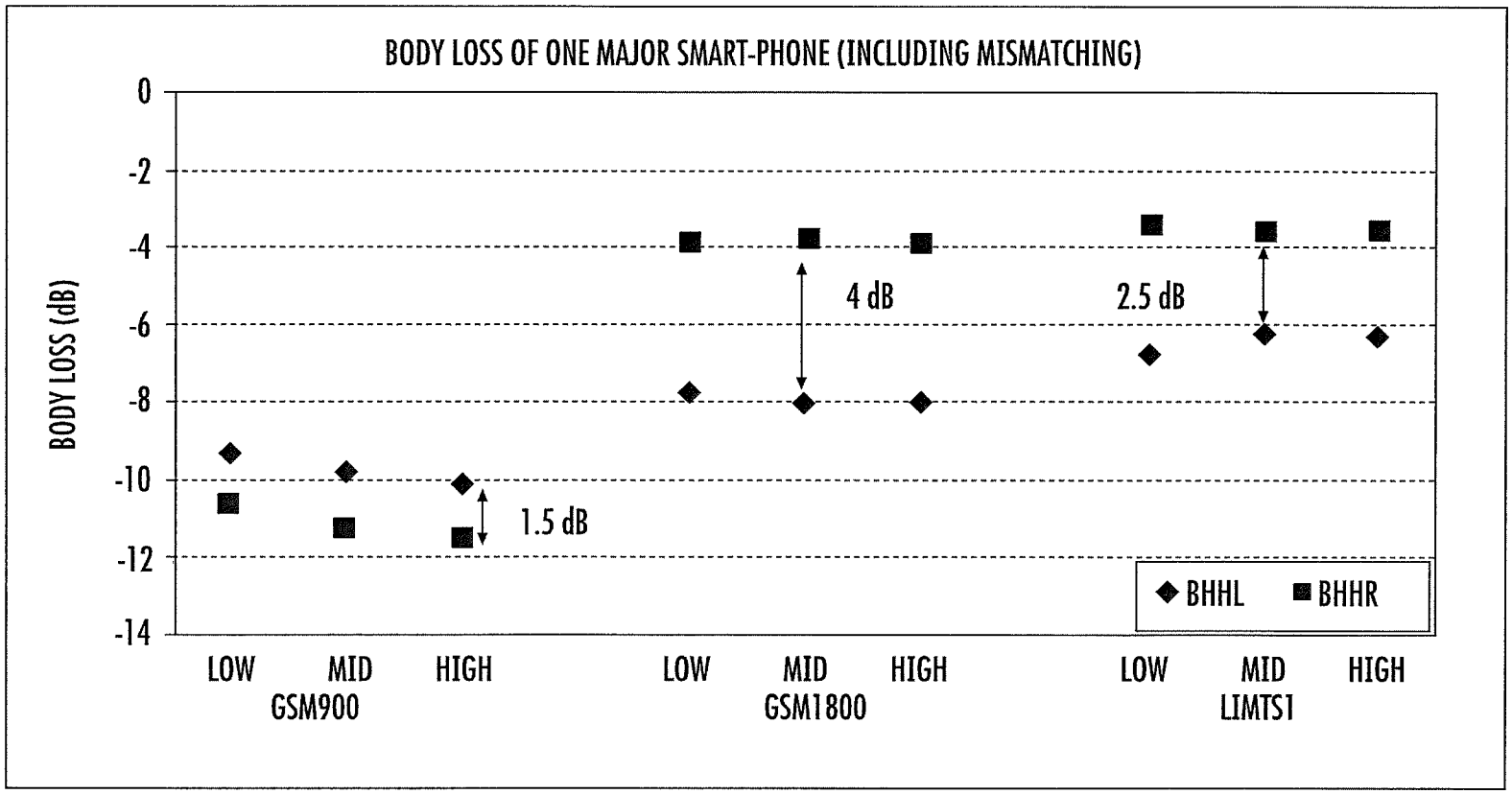
FIG. 1 is a graph illustrating body loss of in a conventional monopole antenna.

The inventive concept will now be described more fully hereinafter with reference to the accompanying drawings, in which embodiments of the inventive concept are shown. This inventive concept may, however, be embodied in many different forms and should not be construed as limited to the embodiments set forth herein; rather, these embodiments are provided so that this disclosure will be thorough and complete, and will fully convey the scope of the inventive concept to those skilled in the art.

It will be understood that, when an element is referred to as being "connected" to another element, it can be directly connected to the other element or intervening elements may be present. In contrast, when an element is referred to as being "directly connected" to another element, there are no intervening elements present. Like numbers refer to like elements throughout.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive concept. As used herein, the term "and/or" includes any and all combinations of one or more of the associated listed items.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

Embodiments of the inventive concept are described herein with reference to schematic illustrations of idealized embodiments of the inventive concept. As such, variations from the shapes and relative sizes of the illustrations as a result, for example, of manufacturing techniques and/or tolerances, are to be expected. Thus, embodiments of the inventive concept should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the inventive concept.

For purposes of illustration and explanation only, various embodiments of the present inventive concept are described herein in the context of a wireless communication terminal ("wireless terminal" or "terminal") that includes an antenna system that is configured to transmit and receive RF signals in two or more frequency bands. The antenna may be configured, for example, to transmit/receive RF communication signals in the frequency ranges used for cellular communications (e.g., cellular voice and/or data communications), WLAN communications, and/or TransferJet communications, etc. without departing from the scope of the present inventive concept.

As discussed above, over the air (OTA) performance tests are commonly performed with head and/or hand phantoms. Typically, a problem is induced by the fact that most antennas included in wireless communications devices have different performance results for left and right sides of the head/hand. Referring to FIG. 1, a graph illustrating the different performance results of both the left (BHHL) and right (BHHR) sides of a conventional monopole antenna will be discussed. As illustrated in FIG. 1, the difference in body loss (dB) in the low frequency band (900 MHz) between left (square) and right (diamond) sides is 1.5 dB. Similarly, the difference in body loss (dB) in the middle frequency band (1800 MHz) between left (square) and right (diamond) sides is 4.0 dB. Finally, the difference in body loss (dB) in the UMTS frequency band (UMTS1) between left (square) and right (diamond) sides is 2.5 dB. Thus, the graph of FIG. 1 illustrates the fact that performance results are different for difference sides, i.e. left and right head and hand.

Since, the performance of the wireless communications device is only as good as the worst result obtained, it would be beneficial to reduce the difference between left and right side performance. Accordingly, it has been determined that the antenna feed should be placed in the center of the printed circuit board of the wireless communications device.

Figure 2A:
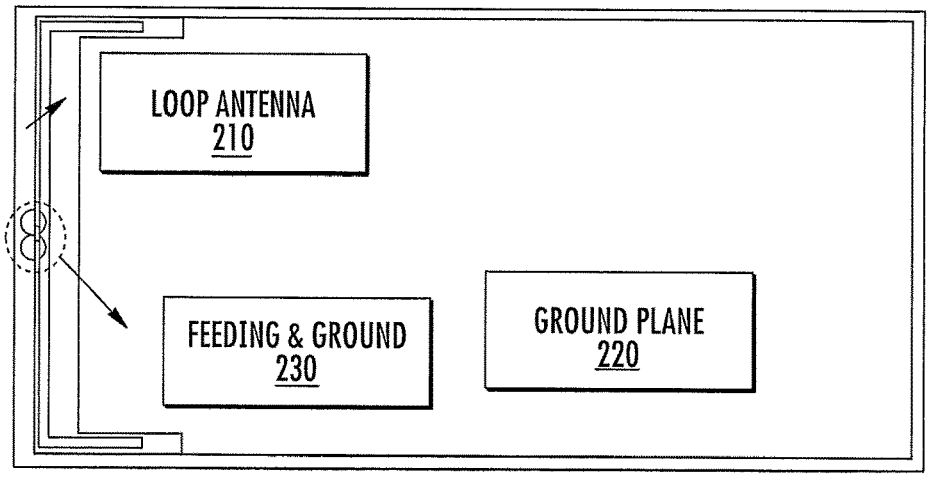
FIGS. 2A through 2C are diagrams illustrating (A) a top view, (B) a side view and (C) a back view of a conventional loop antenna (on ground) with one ground and one feeding in the center of printed circuit board of the portable electronic device.
Figure 2B:
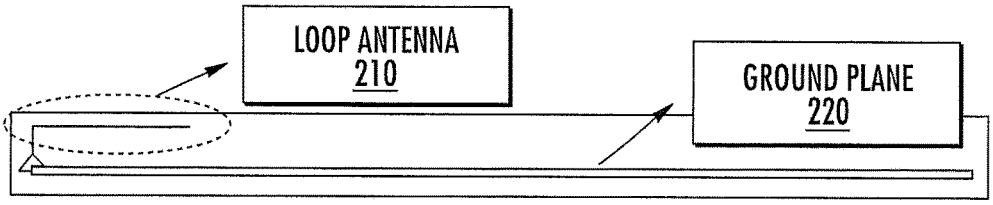
Figure 2C:
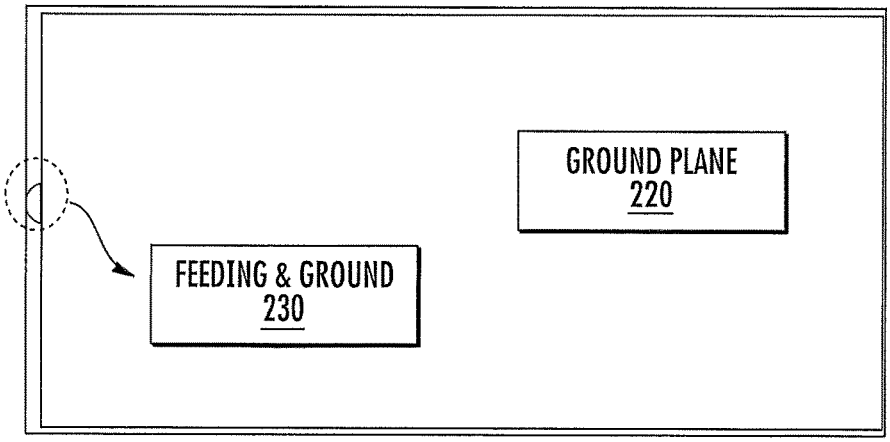

For example, FIGS. 2A through 2C are diagrams illustrating a top view, a cross section from the side and a bottom view, respectively, of a loop antenna (on ground) including an antenna feed placed on the center of the edge of the PCB. As illustrated in FIG. 2A, a loop antenna 210 is provided on a ground plane 220 and the antenna feed 230 is provided on the center of an edge of the ground plane 220.

Figure 3:
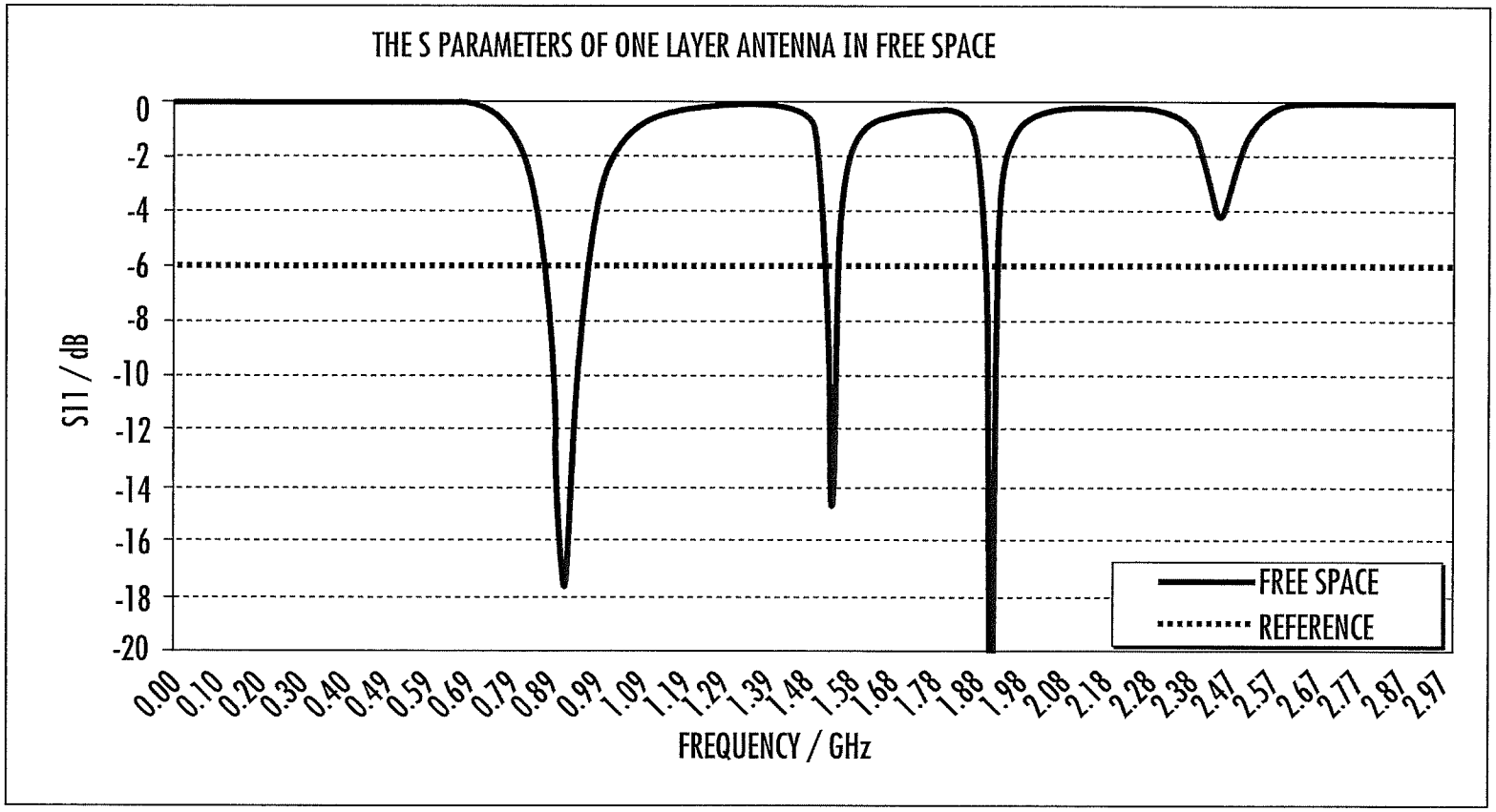
FIG. 3 is a graph illustrating S-parameters (S11) of the conventional loop antenna illustrated in FIG. 2 in free space.
Figure 4A:
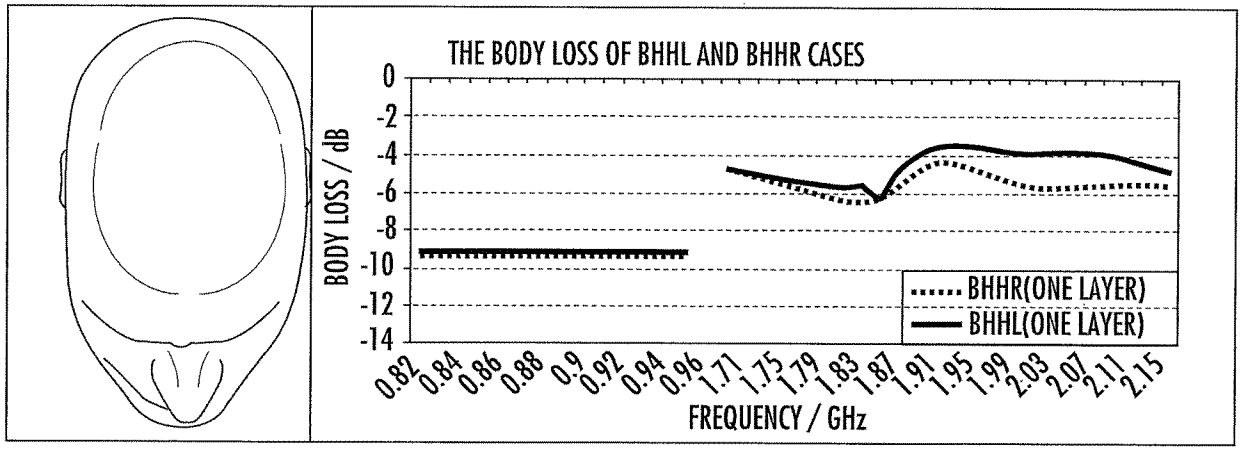
FIGS. 4A and 4B are graphs illustrating performance of the conventional loop antenna in FIG. 2 when the portable electronic device is held in the talking position, i.e. in the hand of the user next to the head of the user.
Figure 4B:
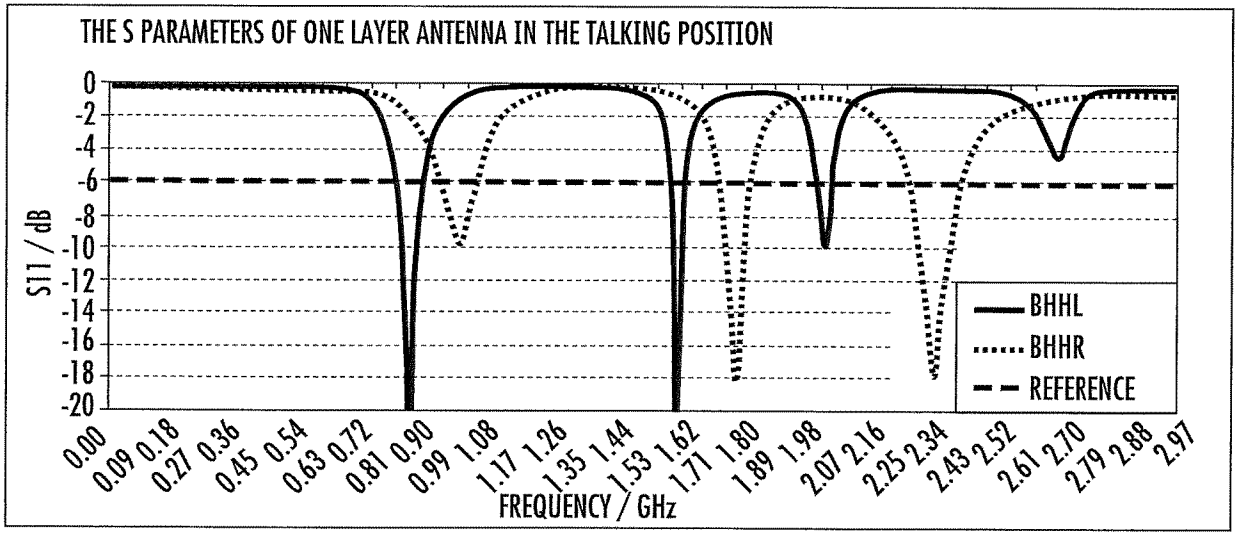

As illustrated in FIGS. 3 and 4A-4B, the performance of the antenna illustrated in FIGS. 2A through 2C, is stabilized in the low frequency band, from about 800 MHz to about 1000 MHz, but is not as stable in the high frequency band, from about 1000 MHz to about 2115 MHz. In particular, as illustrated in FIG. 4A, there is barely any difference in the body loss (dB) of the left (solid line) and the right side (dashed line) in the low frequency band. However, in the high frequency band, a difference of about 2.0 dB is observed between the left (solid line) and the right side (dashed line).

Figure 5D:
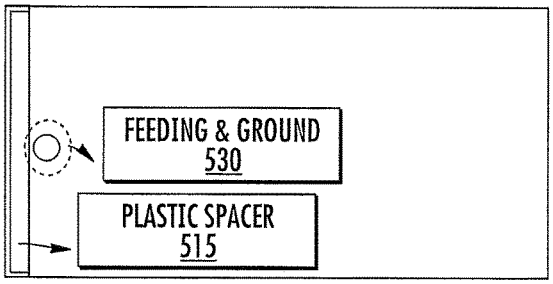

FIGS. 5A-5D are a top view, three dimensional cross sectional view (spacer is hidden), cross section and back view, respectively, of another conventional loop antenna (semi on ground) having a centrally located antenna feed. As illustrated in FIG. 5A, a loop antenna 510 is provided on a ground plane 520 and the antenna feed 530 is provided on an edge in the center of the ground plane 520. However, the loop antenna of FIG. 5A also includes a plastic spacer 515 between the loop antenna 510 and the ground plane 520, which is not included in the antenna discussed above with respect to FIGS. 2A-2C.

Figure 5E:
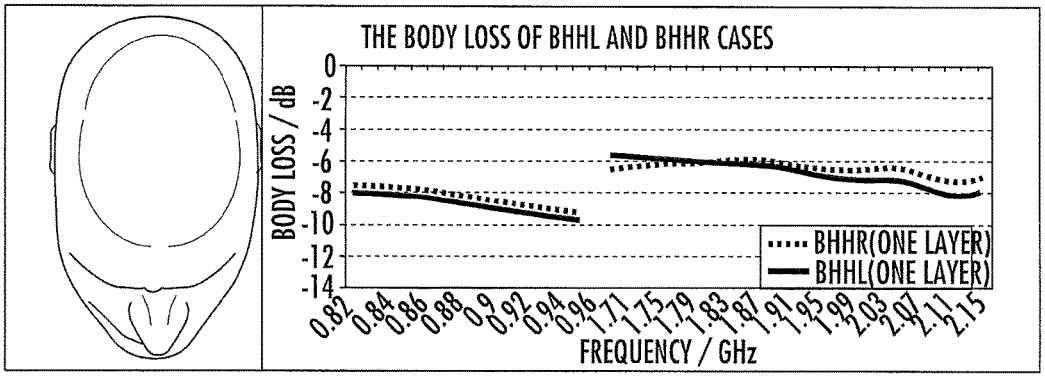
FIGS. 5E through 5F are graphs illustrating performance of the conventional loop antenna in FIGS. 5A-5D when the portable electronic device is held in the talking position, i.e. in the hand of the user next to the head of the user.
Figure 5F:
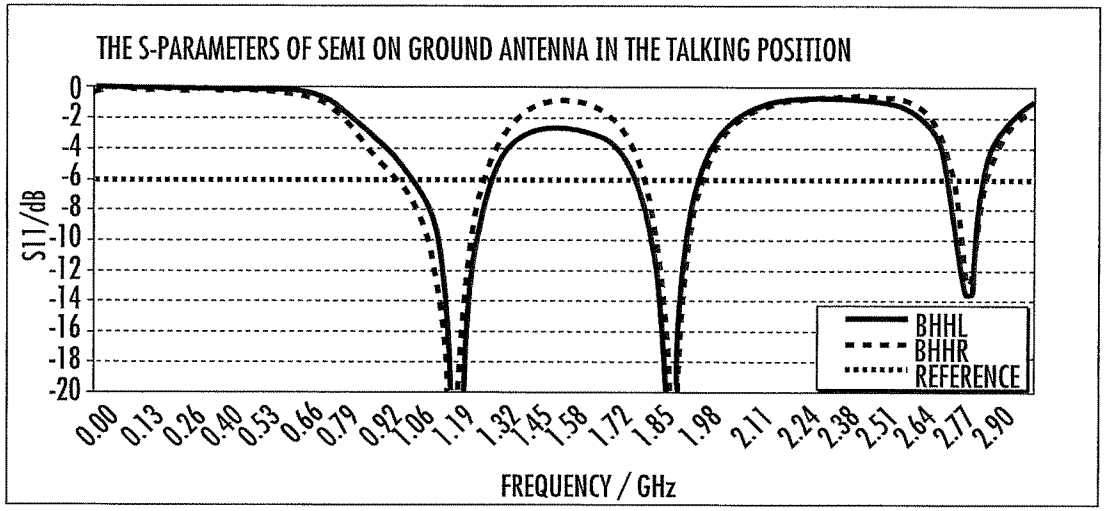

As illustrated in FIGS. 5E and 5F, the body loss of the antenna illustrated in FIGS. 5A through 5D, is stabilized in the high and low frequency bands (FIG. 5E), but the S parameter (matching) is not good enough, since the high frequency bandwidth is needed from 1.71-2.17 GHz.

Thus, according to some embodiments of the present inventive concept, antennas are provided including a floating multi-resonant parasitic element, which may provide improved performance in the high frequency band as discussed below with respect to FIGS. 6A through 15.

Referring first to FIGS. 6A-6E illustrating a top view of a first layer, a top view of a second layer, a three dimensional view (spacer is hidden), a side view (cross section with spacer hidden) and a back view, respectively, of a loop antenna having a floating multi-resonant parasitic element in accordance with some embodiments of the present inventive concept will be discussed. As illustrated in FIG. 1, the antenna system includes a loop antenna 611 having a multi-branch (thus multi-resonant) parasitic element 650 and a plastic spacer 615 between the multi-branch parasitic element 650 and the loop antenna 611. The multi-branch parasitic element 650 is provided on a first layer 660 of the antenna system.

Figure 6B:
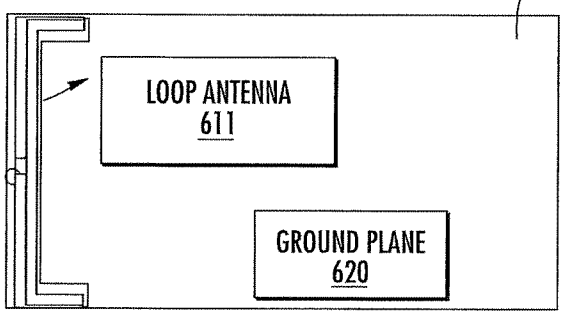
FIGS. 6A through 6E are diagrams illustrating a loop antenna (on ground) with multi-branch parasitic element in accordance with some embodiments of the present inventive concept.
Figure 6A:
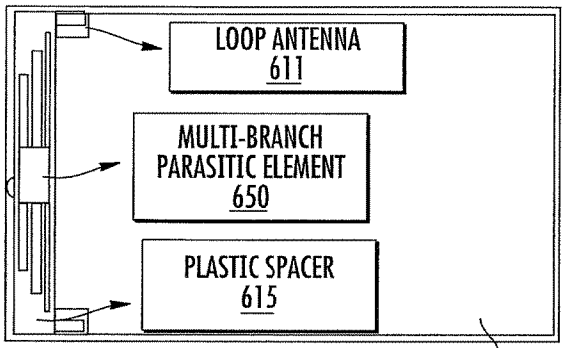

A second layer 662 is illustrated in FIG. 6B. As illustrated therein, the second layer 662 includes the loop antenna 611 on the ground plane 620. As discussed above, the plastic spacer 615 is positioned between the multi-branch parasitic element 650 and the loop antenna 611. Thus, the loop antenna 611 is positioned between the multi-branch parasitic element 650 and the ground plane 620 as illustrated in FIG. 6C (spacer is not shown).

Figure 6D:
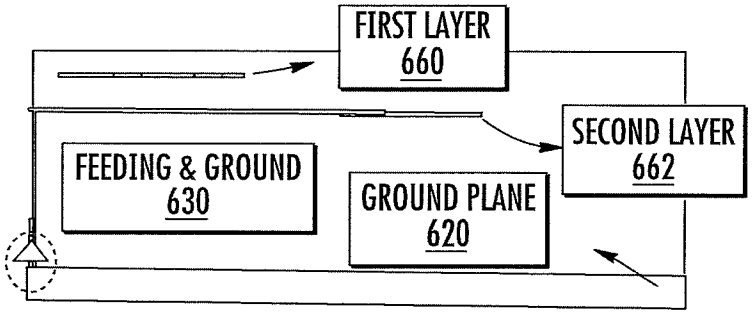
Figure 6C:
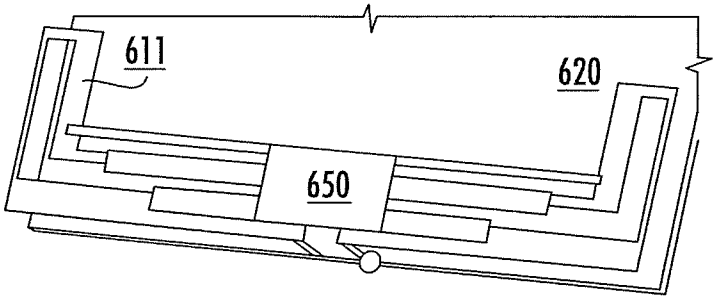
Figure 6E:
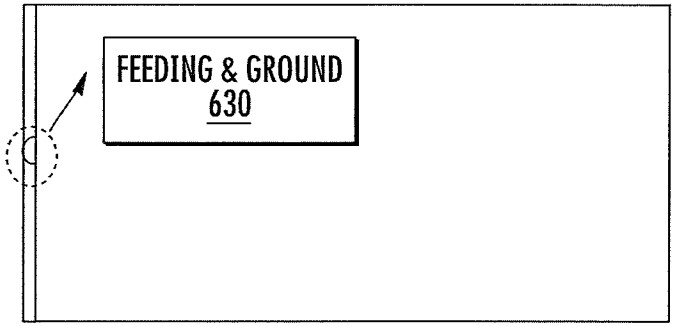

The first 660 and second 662 layers are illustrated in FIG. 6D. As is clear from FIG. 6D, the first layer 660 including the multi-parasitic element is provided above the second layer 662, which includes the loop antenna 611. FIG. 6D also illustrates the antenna feed 630, which is centrally located on an edge the ground plane 620. The bottom view illustrated in FIG. 6E further illustrates the central location of the antenna feed 630 discussed above.

Figures 7A, 7B:
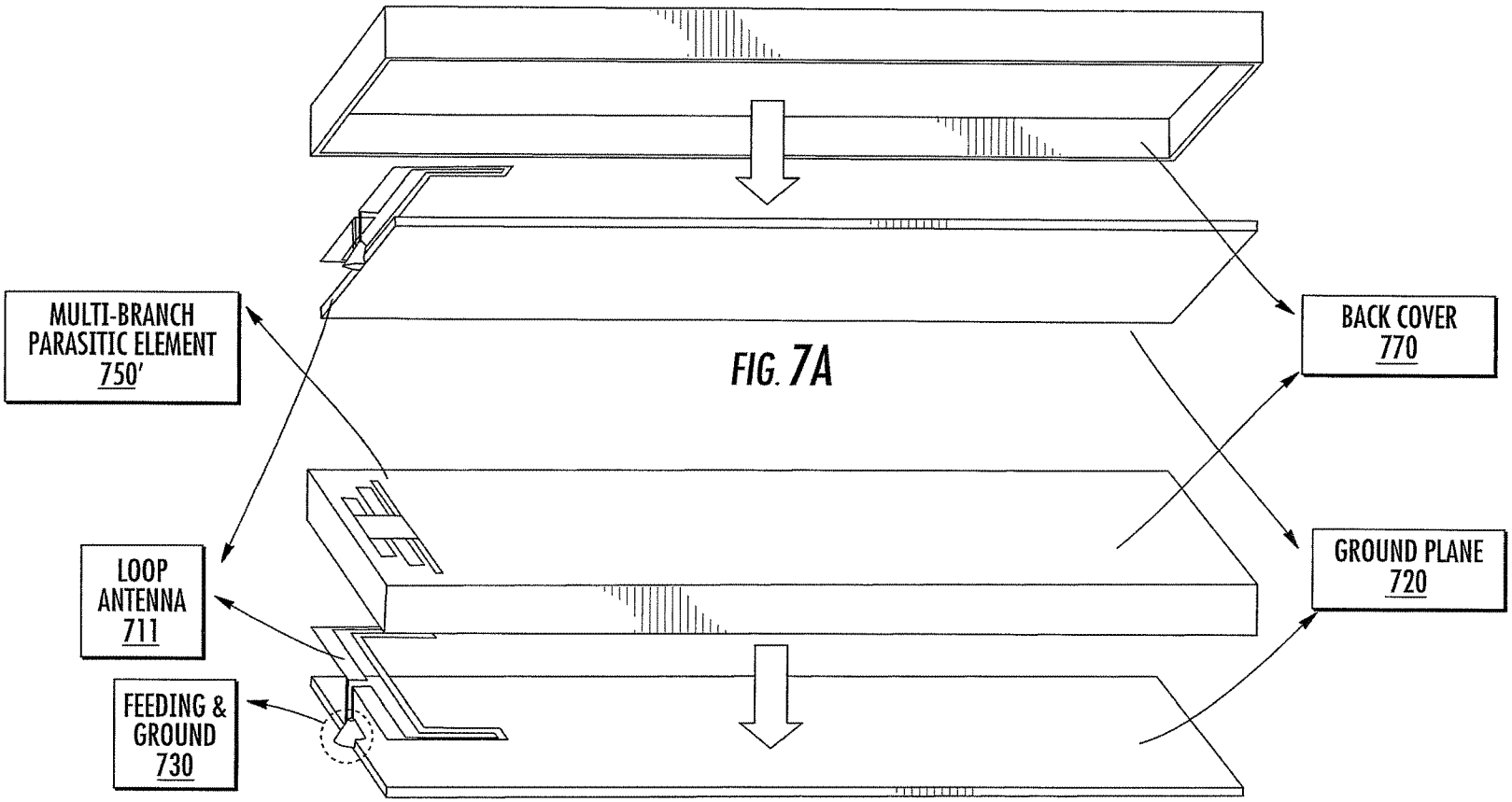
FIGS. 7A and 7B are diagrams illustrating a portable electronic device including a Multi-branch parasitic element in accordance with some embodiments of the present inventive concept.

In some embodiments of the present inventive concept, the multi-branch parasitic element 750' may be integrated into the back cover 770 of the wireless communication terminal as illustrated in FIGS. 7A and 7B. FIGS. 7A and 7B are exploded views of embodiments having the multi-branch parasitic element 750' in accordance with some embodiments integrated with the back cover 770 of the device.

Figures 8A, 8B:
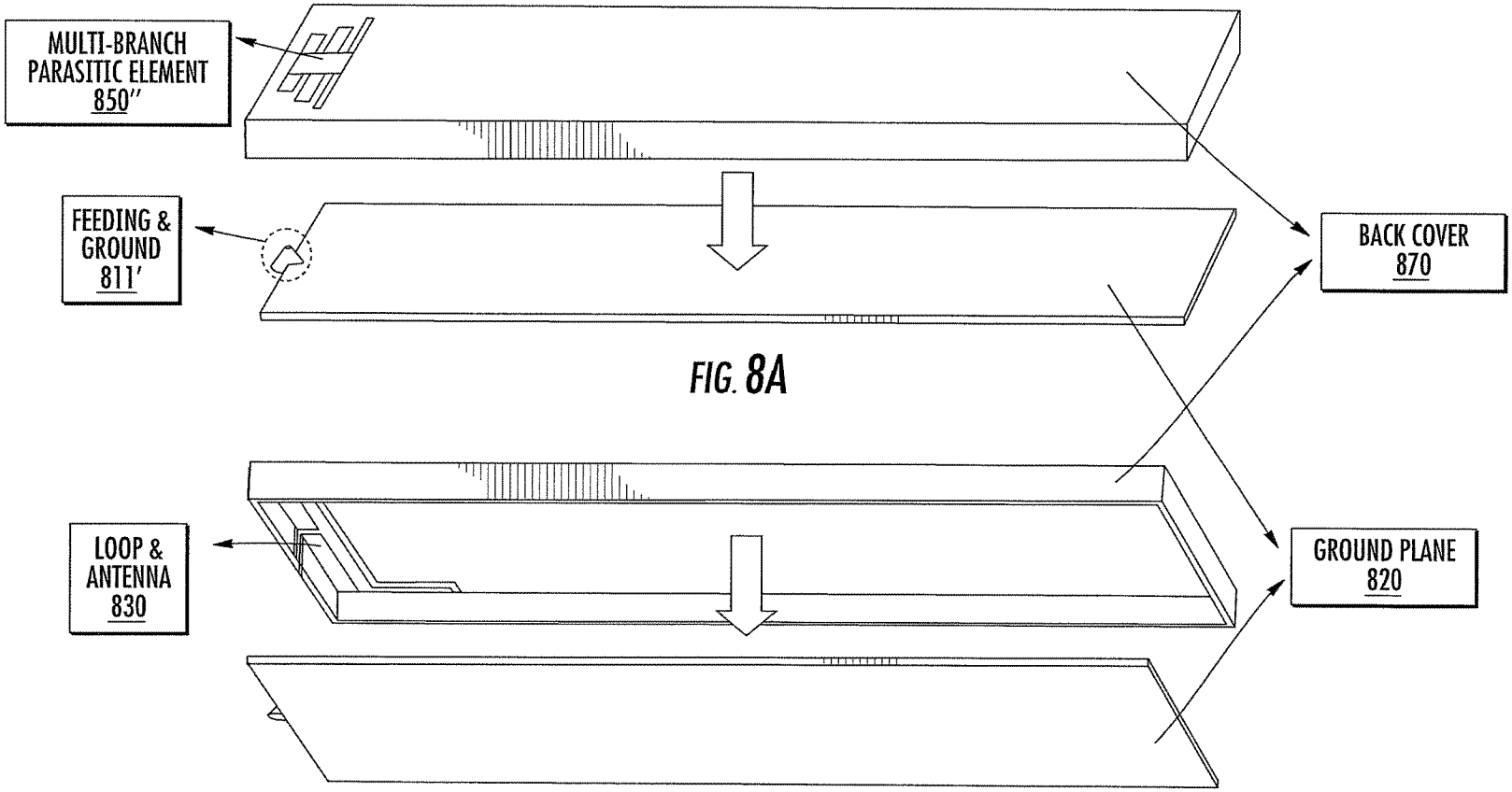
FIGS. 8A and 8B are diagrams illustrating a portable electronic device including a multi-branch parasitic element in accordance with some embodiments of the present inventive concept.

Referring now to the exploded views of FIGS. 8A and 8B, in some embodiments, the multi-branch parasitic element 850" and the loop antenna 811' can be integrated on opposite sides of the back cover 870 of the wireless communications terminal.

It will be understood that embodiments illustrated in FIGS. 6A through 8B are provided for exemplary purposes only. Embodiments of the present inventive concept are not limited to this configuration.

Figure 9:
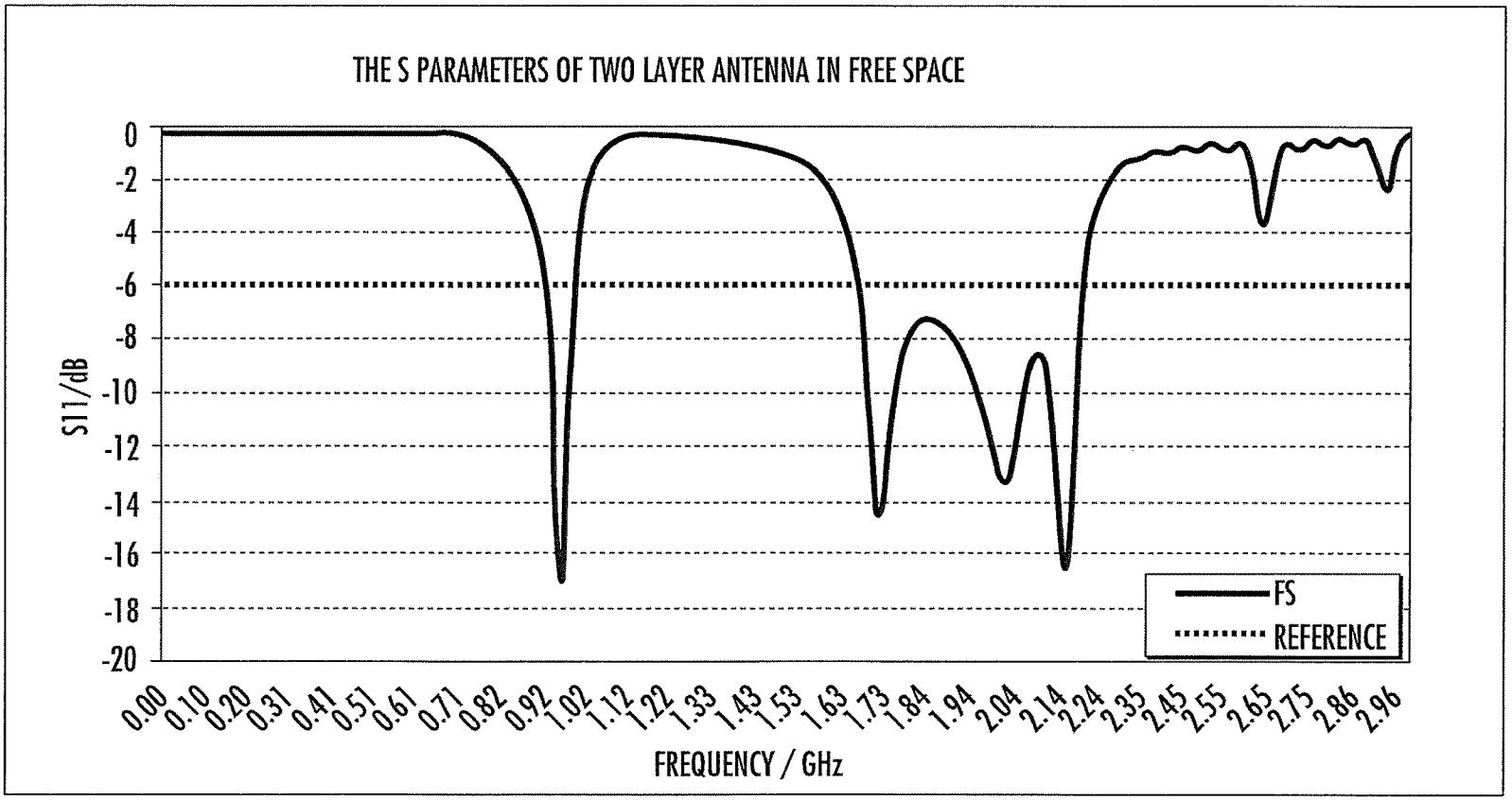
FIG. 9 is a graph illustrating S-parameters (S11) of the loop antenna illustrated in FIGS. 6A-6E in accordance with some embodiments of the present inventive concept.

FIG. 9 is a graph illustrating S-parameters (S11) of the loop antenna of FIGS. 6A-6E in accordance with some embodiments in free space (i.e. not near the head or in the hand) will be discussed. The solid line depicts S-parameters in free space (FS) and the dotted line is the reference line.

Figure 10A:
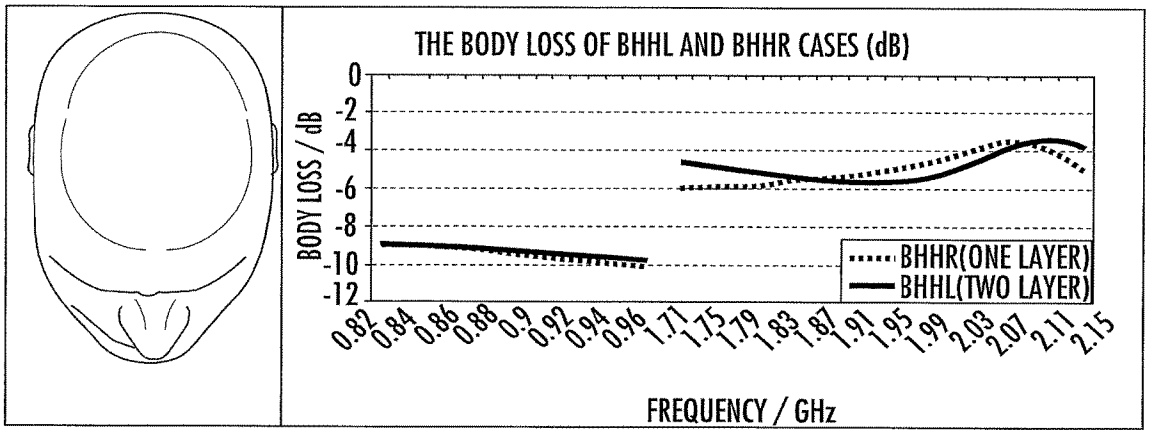
FIGS. 10A and 10B are graphs illustrating performance characteristics of the loop antenna illustrated in FIGS. 6A-6E in accordance with some embodiments of the present inventive concept.

When the head and hand are introduced, the performance results change. For example, FIG. 10A illustrates the body loss for both right (dotted line) and left (solid line) sides for embodiments of the present inventive concept illustrated in FIGS. 6A-6E. As illustrated in therein, the body loss in the high frequency band, for example, from about 1000 MHz to about 2150 MHz varies less than about 1.0 at the most. Thus, performance of the right and left sides are more symmetrical for antennas including a multi-branch parasitic element as illustrated, for example, in FIGS. 6A through 6E set out above.

Figure 10B:
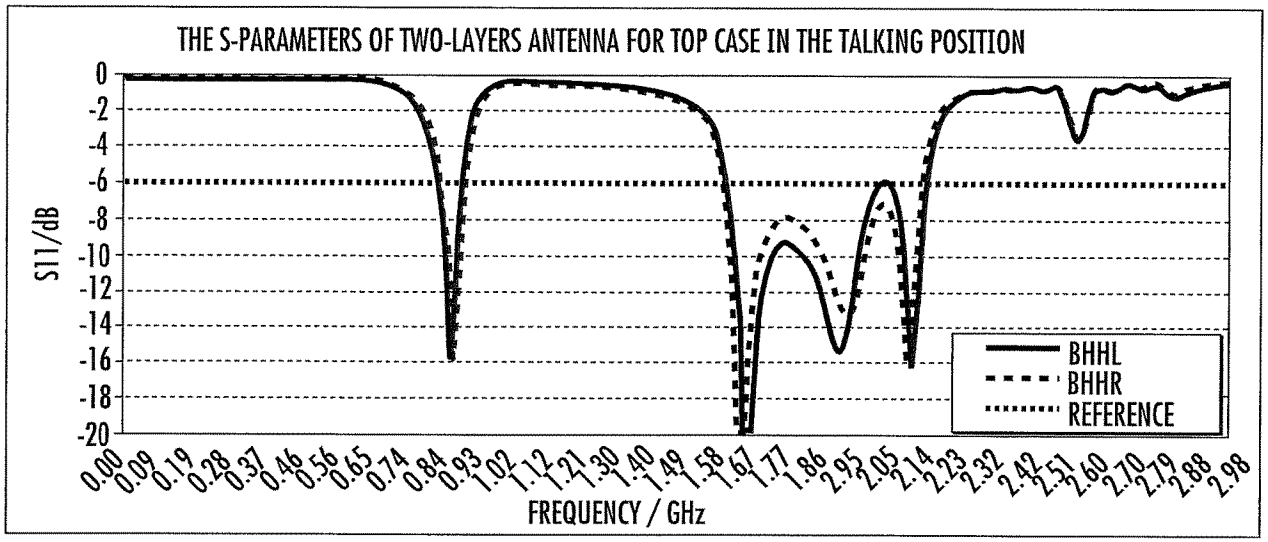

FIG. 10B illustrates the S parameters (S11) for the loop antenna of FIGS. 6A-6E. As illustrated in FIG. 10, the S parameters (S11) for the left side (solid line) and the right side (dotted line) are fairly symmetrical for all frequencies.

Figure 11:
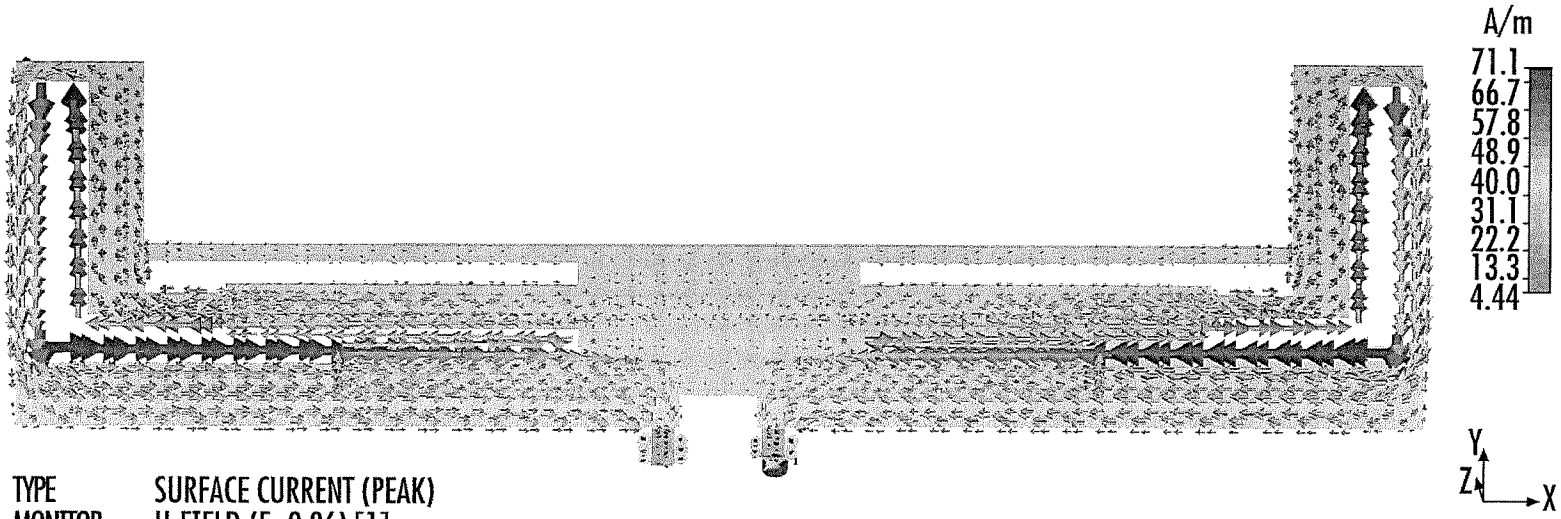
FIG. 11 is a graph illustrating current distribution of the loop antenna illustrated in FIGS. 6A-6E in a low frequency band, for example, 960 MHz, in accordance with some embodiments of the present inventive concept.
Figure 12:
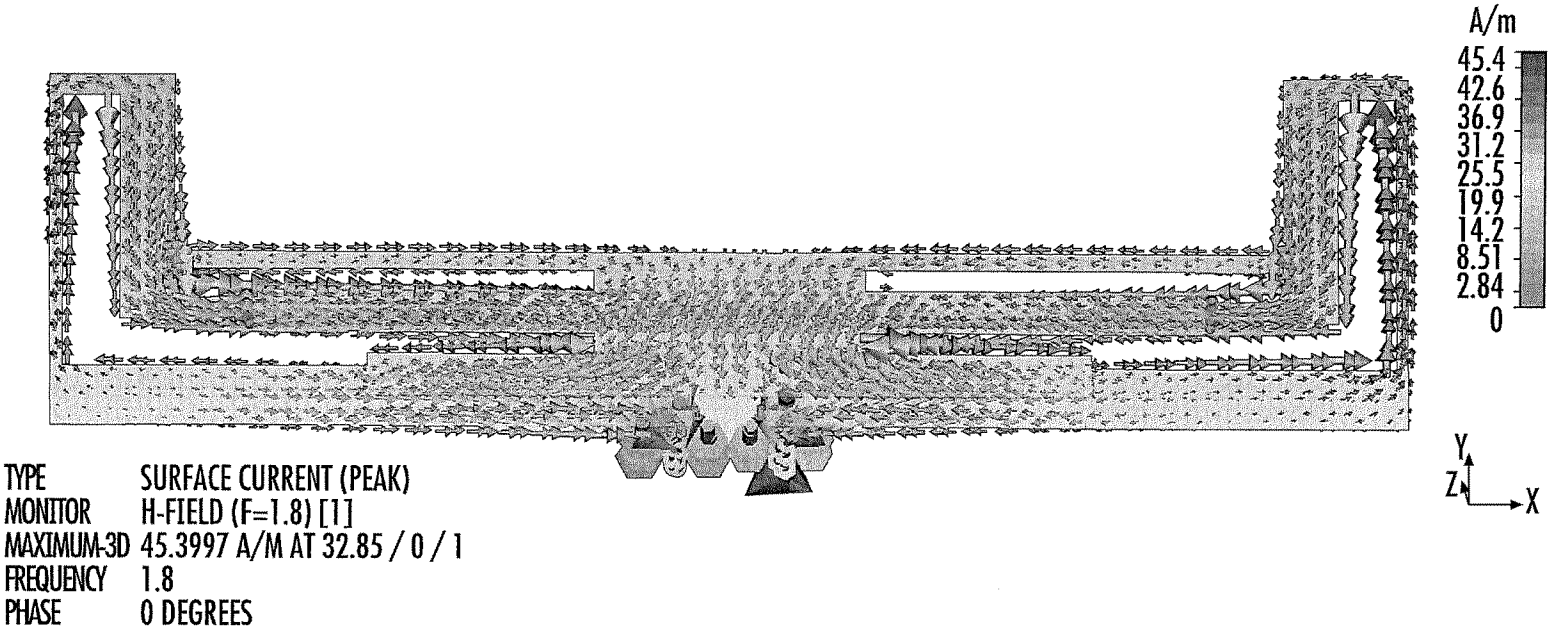
FIG. 12 is a graph illustrating current distribution of the loop antenna illustrated in FIGS. 6A-6E at a high frequency band, for example, 1800 MHz, in accordance with some embodiments of the present inventive concept.
Figure 13:
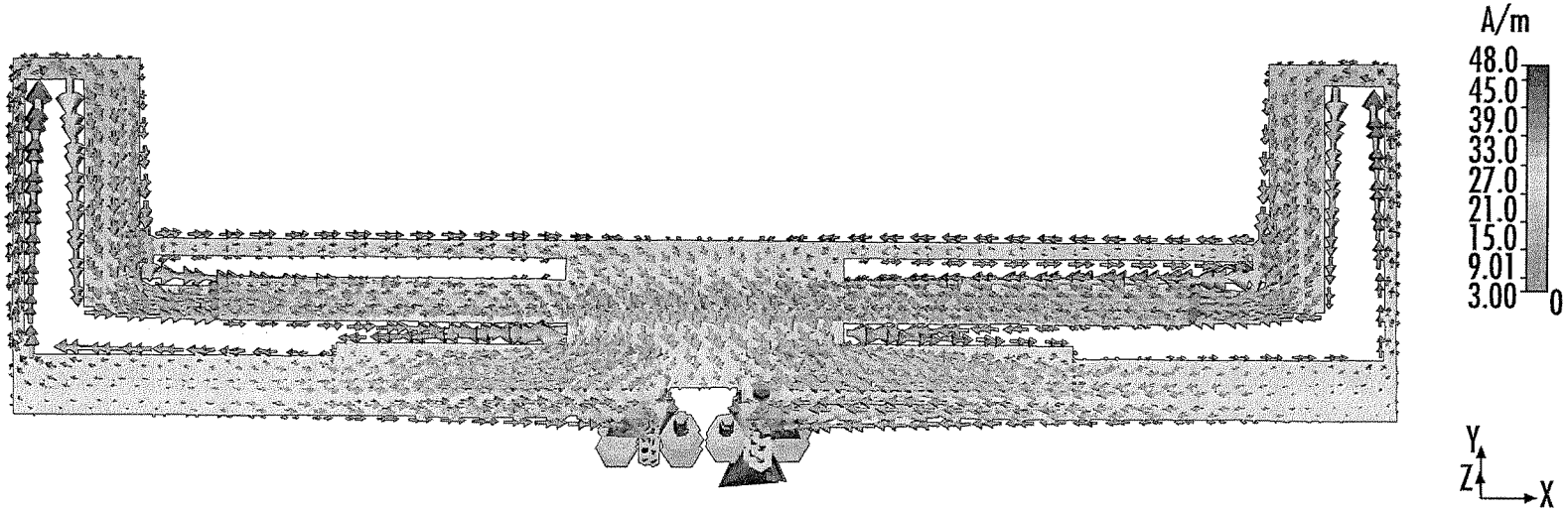
FIG. 13 is a graph illustrating current distribution of the loop antenna illustrated in FIGS. 6A-6E at a high frequency band, for example, 1900 MHz, in accordance with some embodiments of the present inventive concept.
Figure 14:
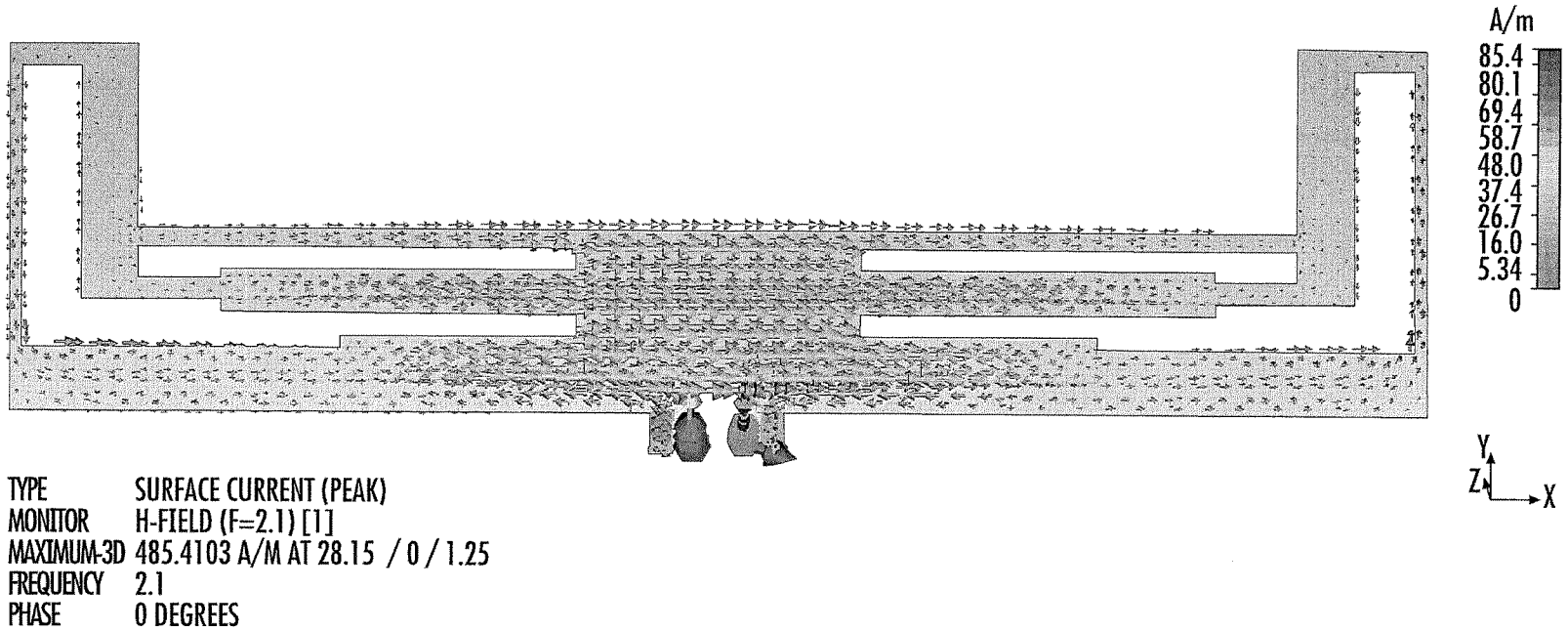
FIG. 14 is a graph illustrating current distribution of the loop antenna illustrated in FIGS. 6A-6E at a high frequency band, for example, 2100 MHz, in accordance with some embodiments of the present inventive concept.

FIGS. 11 through 14 are graphs illustrating current distribution for various frequencies bands for the loop antenna in accordance with some embodiments of the present inventive concept. In particular, the graph of FIG. 11 illustrates current distribution of the loop antenna of FIGS. 6A through 6E for low frequency bands, for example, 960 MHz. Similarly, the graph of FIG. 12 illustrates current distribution of the loop antenna of FIGS. 6A through 6E for high frequency bands, for example, 1800 MHz. The graph of FIG. 13 illustrates current distribution of the loop antenna of FIGS. 6A through 6E for high frequency bands, for example, 1900 MHz. The graph of FIG. 14 illustrates current distribution of the loop antenna of FIGS. 6A through 6E for high frequency bands, for example, 2100 MHz. As can be concluded from FIGS. 11-14, performance of loop antennas in accordance with embodiments discussed herein are relatively symmetrical for both low and high frequency ranges.

Figure 15:
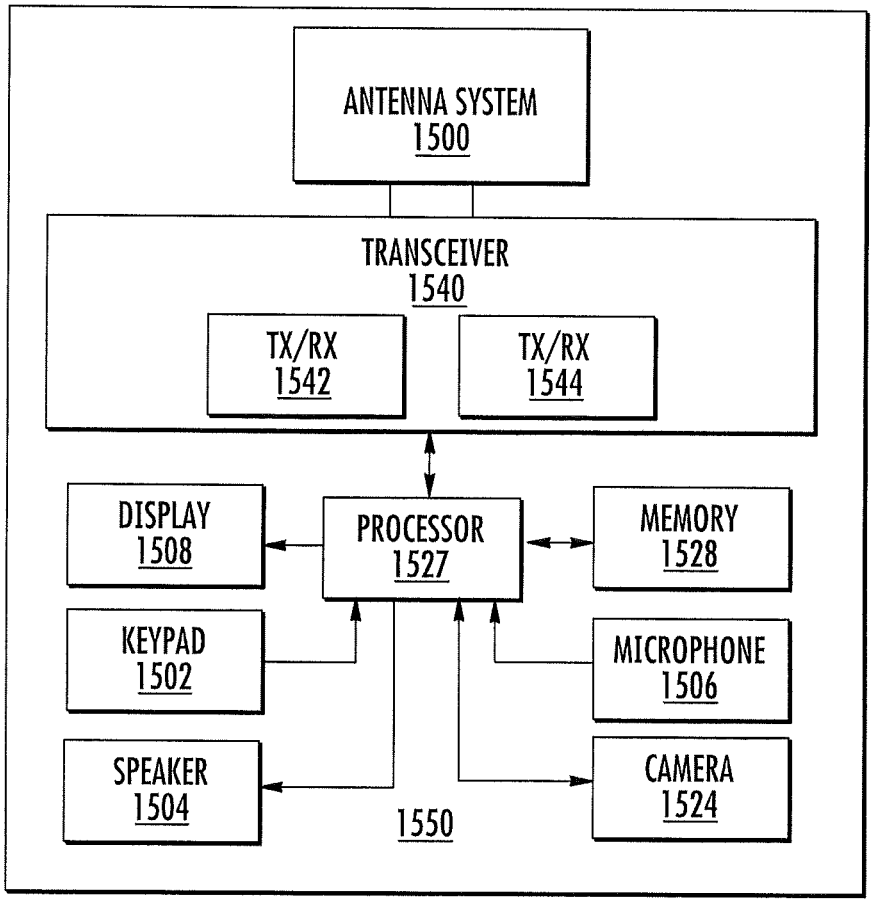
FIG. 15 is a block diagram of some electronic components, including an antenna system, of a wireless communication terminal in accordance with some embodiments of the present inventive concept.

Referring now to FIG. 15, a block diagram of a wireless communication terminal 1550 that includes an antenna system 1500 in accordance with some embodiments of the present inventive concept will be discussed. As illustrated in FIG. 15, the terminal 1550 includes an antenna system 1500, a transceiver 1540, a processor 1527, and can further include a conventional display 1508, keypad 1502, speaker 1504, mass memory 1528, microphone 1506, and/or camera 1524, one or more of which may be electrically grounded to the same ground plane as the antenna 1500. The antenna 1500 may be structurally configured as shown for the antenna systems of FIGS. 6A through 8B or may be configured in accordance with various other embodiments of the present inventive concept.

The transceiver 1540 may include transmit/receive circuitry (TX/RX) that provides separate communication paths for supplying/receiving RF signals to one or more radiating elements of the antenna system 1500.

The transceiver 1540 in operational cooperation with the processor 1527 may be configured to communicate according to at least one radio access technology in two or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), Universal Mobile Telecommunications System (UMTS), Global Standard for Mobile (GSM) communication, General Packet Radio Service (GPRS), enhanced data rates for GSM evolution (EDGE), DCS, PDC, PCS, code division multiple access (CDMA), wideband-CDMA, and/or CDMA2000. Other radio access technologies and/or frequency bands can also be used in embodiments according to the inventive concept.

As discussed briefly above, providing a loop antenna including a floating multi-branch parasitic element may reduce the variation in performance between the left and right sides.

It will be appreciated that certain characteristics of the components of the antennas systems illustrated in the Figures such as, for example, the relative widths, conductive lengths, and/or shapes of the radiating elements, and/or other elements of the antennas may vary within the scope of the present inventive concept. Thus, many variations and modifications can be made to the embodiments without substantially departing from the principles of the present inventive concept. All such variations and modifications are intended to be included herein within the scope of the present inventive concept, as set forth in the following claims.

What is claimed is:

1. An antenna system, comprising:

a ground plane;

a loop antenna positioned on the ground plane on a first layer, the loop antenna comprising an antenna feed positioned at a center of an edge of the first layer; and a multi-branch parasitic element electrically coupled to the loop antenna, the multi-branch parasitic element being parallel to and positioned above the ground plane on a second layer, different from the first layer, wherein the loop antenna on the first layer is positioned between the ground plane and the multi-branch parasitic element on the second layer, wherein the ground plane, first layer and second layer are parallel to one another, and wherein the multi-branch parasitic element is simultaneously resonant at a plurality of resonant frequencies.

2. The antenna system of claim 1, further comprising a plastic spacer positioned between the loop antenna and the multi-branch parasitic element.

3. The antenna system of claim 1, wherein the loop antenna is one of grounded, semi-on grounded and ground free.

4. The antenna system of claim 1, wherein the antenna system provides a decrease in body loss between left and right sides of a user in a high frequency band, wherein body loss is a measurement of antenna performance when positioned in a right hand and/or a left hand at a right and/or left side of a human head, respectively.

5. The antenna system of claim 4, wherein the high frequency band is from about 1700 MHz to beyond 2700 MHz.

6. The antenna system of claim 1, further comprising a back cover of a wireless communications device, wherein the multi-branch parasitic element is integrated with an outer surface of the back cover of the wireless communications device.

7. The antenna system of claim 1, further comprising a back cover of a wireless communications device, wherein the multi-branch parasitic element is integrated on a first surface of the back cover of the wireless communications device and wherein the loop antenna is integrated with a second surface of the wireless communications device, the second surface being opposite the first surface.

8. A wireless communications device comprising:

a housing; and an antenna system coupled to the housing, the antenna system comprising:

a ground plane;

a loop antenna positioned on the ground plane on a first layer, the loop antenna comprising an antenna feed positioned at a center of an edge of the first layer; and a multi-branch parasitic element electrically coupled to the loop antenna, the multi-branch parasitic element being parallel to and positioned above the ground plane on a second layer, different from the first layer, wherein the loop antenna on the first layer is positioned between the ground plane and the multi-branch parasitic element on the second layer, wherein the ground plane, first layer and second layer are parallel to one another, and wherein the multi-branch parasitic element is simultaneously resonant at a plurality of resonant frequencies.

9. The wireless communications device of claim 8, wherein the antenna system further comprises a plastic spacer positioned between the loop antenna and the multi-branch parasitic element.

10. The wireless communications device of claim 8, wherein the loop antenna is one of grounded, semi-on grounded and ground free.

11. The wireless communications device of claim 8, wherein the antenna system provides a decrease in body loss between left and right sides of a user in a high frequency band, wherein body loss is a measurement of antenna performance of the antenna system when the wireless communications device is positioned in a right hand and/or a left hand at a right and/or left side of a human head, respectively.

12. The wireless communications device of claim 11, wherein the high frequency band is from about 1700 MHz to beyond 2700 MHz.

13. The wireless communications device of claim 8, wherein the housing further comprises a back cover and wherein the multi-branch parasitic element is integrated with an outer surface of the back cover of the wireless communications device.

14. The wireless communications device of claim 8, wherein the housing further comprises a back cover, wherein the multi-branch parasitic element is integrated on a first surface of the back cover of the wireless communications device and wherein the loop antenna is integrated with a second surface of the wireless communications device, the second surface being opposite the first surface.

15. A loop antenna comprising:

a ground plane;

a loop antenna positioned on the ground plane on a first layer, the loop antenna comprising an antenna feed positioned at a center of an edge of the first layer; and a floating multi-branch parasitic element being parallel to and positioned above the ground plane on a second layer, different from the first layer, the floating multi-branch parasitic element being configured to reduce a performance difference of the loop antenna in high frequency bands between first and second positions, the first position being when a wireless communications device is positioned in a right hand at a right side of a human head and the second position being when the wireless communications device is positioned in a left hand at a left side of the human head, wherein the loop antenna on the first layer is positioned between the ground plane and the multi-branch parasitic element on the second layer, wherein the ground plane, first layer and second layer are parallel to one another, and wherein the floating multi-branch parasitic element is simultaneously resonant at a plurality of resonant frequencies.

16. The loop antenna of claim 15, wherein the performance difference between the first and second positions is reduced to no greater than about 1.0 dB in the high frequency band.

17. The loop antenna of claim 15, wherein the loop antenna is one of grounded, semi-on grounded and ground free.

18. The loop antenna of claim 15, where the multi-branch parasitic element is integrated with an outer surface of a back cover of a wireless communications device.

19. The loop antenna of claim 15, wherein the multi-branch parasitic element is integrated on a first surface of a back cover of a wireless communications device and wherein the loop antenna is integrated with a second surface of the wireless communications device, the second surface being opposite the first surface.

* * * * *